US011927412B1

(12) United States Patent
Kunsky

(10) Patent No.: US 11,927,412 B1
(45) Date of Patent: Mar. 12, 2024

(54) PISTOL SUPPRESSOR

(71) Applicant: Jacob Kunsky, Bruneau, ID (US)

(72) Inventor: Jacob Kunsky, Bruneau, ID (US)

( * ) Notice: Subject to any disclaimer, the term of this patent is extended or adjusted under 35 U.S.C. 154(b) by 0 days.

(21) Appl. No.: 18/148,110

(22) Filed: Dec. 29, 2022

Related U.S. Application Data

(60) Provisional application No. 63/408,206, filed on Sep. 20, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 2,457,802 A * 1/1949 Bauer ..... F41A 21/30 89/14.3
3,776,093 A * 12/1973 Leverance ..... F41A 21/30 89/14.4
4,341,283 A * 7/1982 Mazzanti ..... F01N 1/06 181/275
4,588,043 A * 5/1986 Finn ..... F41A 21/30 89/14.4
6,575,074 B1 * 6/2003 Gaddini ..... F41A 21/30 89/14.4
7,237,467 B1 * 7/2007 Melton ..... F41A 21/34 89/14.4
7,931,118 B1 * 4/2011 Cronhelm ..... F41A 21/30 89/14.4
8,196,701 B1 * 6/2012 Oliver ..... F41A 21/30 89/14.4
8,459,405 B1 * 6/2013 Dueck ..... F41A 21/34 89/14.4
2007/0107590 A1 * 5/2007 Silvers ..... F41A 21/34 89/14.4
2009/0139795 A1 * 6/2009 Brittingham ..... F41A 21/30 181/223
2010/0163336 A1 * 7/2010 Presz, Jr. ..... F41A 13/08 181/223
2012/0145478 A1 * 6/2012 Brittingham ..... F41A 21/30 181/264
2012/0180624 A1 * 7/2012 Troy ..... F41A 21/30 89/14.4

(Continued)

*Primary Examiner* — Joshua E Freeman
*Assistant Examiner* — Benjamin S Gomberg
(74) *Attorney, Agent, or Firm* — Parsons Behle & Latimer

(57) ABSTRACT

A suppressor that includes a mount having a first flow path through the mount, the mount configured to connect directly to a barrel of a semi-automatic pistol. The suppressor includes a base tube having an initial expansion chamber and having a second flow path through the initial expansion chamber with the base tube being connected to the mount, the second flow path aligned with the first flow path. The suppressor includes a single baffle having a third flow path connected to the base tube, the third flow path aligned with the second flow path. The suppressor includes an end cap having a fourth flow path connected to the single baffle, the fourth flow path aligned with the third flow path. The single baffle may be the only baffle positioned between the base tube and the end cap. The suppressor does not include any wipes and may include a tube extension.

18 Claims, 7 Drawing Sheets

(56) References Cited

U.S. PATENT DOCUMENTS

| | | | | |
|---|---|---|---|---|
| 2013/0263490 | A1* | 10/2013 | Oliver | F41C 27/00<br>42/90 |
| 2014/0076658 | A1* | 3/2014 | Smith, II | F41A 21/30<br>181/223 |
| 2014/0318887 | A1* | 10/2014 | Latka | F41A 21/30<br>181/296 |
| 2016/0084602 | A1* | 3/2016 | Smith | F41A 21/325<br>89/14.05 |
| 2017/0038172 | A1* | 2/2017 | Palu | F41A 21/30 |
| 2017/0350669 | A1* | 12/2017 | Latka | F41A 21/30 |
| 2018/0202742 | A1* | 7/2018 | Brittingham | F41A 21/34 |
| 2018/0340750 | A1* | 11/2018 | Mooty | F41A 21/34 |
| 2019/0339036 | A1* | 11/2019 | Edminster | F41A 21/30 |
| 2020/0309478 | A1* | 10/2020 | Meaux | F41A 21/30 |
| 2021/0071978 | A1* | 3/2021 | Washburn, III | F41A 21/30 |
| 2021/0116200 | A1* | 4/2021 | Graham, II | F41A 21/30 |
| 2021/0190453 | A1* | 6/2021 | Kunsky | F41A 21/30 |
| 2021/0389074 | A1* | 12/2021 | Reis-Green | F41A 21/325 |

* cited by examiner

PISTOL SUPPRESSOR

RELATED APPLICATION

This application claims the benefit of priority under 35 U.S.C. § 119 to U.S. Provisional Patent Application Ser. No. 63/408,206 entitled "PISTOL SUPPRESSOR" filed on Sep. 20, 2022, which is incorporated herein in its entirety.

FIELD OF THE DISCLOSURE

The embodiments described herein relate to a suppressor for semi-automatic pistols.

DESCRIPTION OF THE RELATED ART

During the discharge of a round, the barrel of a semi-automatic pistol recoils a short distance before the slide is unlocked. Typically, the barrel of the pistol actually tilts causing the lugs on the barrel and the slide to separate to unlock the slide and allow the gun to cycle the action after each discharge. The addition of a suppressor to the end of the barrel generally interferes with the tilting of the barrel interfering with the cycling action. The additional weight added to the barrel by a suppressor that effectively suppresses the discharge of the firearm interferes with the cycling action. One prior effort to attach a suppressor directly to a semi-automatic firearm was to use wipes within the suppressor. The wipes enabled the suppressor to be shorter and lighter than conventional pistol suppressors that use baffles without wipes. However, the wipes deteriorate upon each round discharged through the suppressor. Such suppressors typically lose the ability to effectively suppress the sound of the discharge within the firing of a single magazine of ammunition.

A known solution to connect a suppressor to the barrel 210 of a semi-automatic pistol 200 is to use a recoiled booster 310 as shown in FIG. 17. The booster 310, also referred to as a Nielsen device or a linear inertial decoupler ("LID") device, permits the use of a suppressor 300 with semi-automatics pistols by temporarily decoupling the suppressor 300 from the barrel 210, which allows the firearm to properly cycle the action after each discharge. One disadvantage of using a booster 310 or LID device is that it adds to the overall length 301 and weight of the suppressor 300 being added to the end of a pistol 200. Further, a pistol 200 with a suppressor 300 connected to the barrel 210 generally may not be inserted into a holster as the suppressor 300 prevents such insertion. Due to the length of typical pistol suppressors 300, a pistol 200 may also be hard to conceal when a suppressor 300 is connected to the barrel 210.

Another potential disadvantage of using a pistol suppressor 300 is the large outer diameter (OD) 302 of the suppressor 300 may interfere with the user of the sights 202, 203 on the pistol 200. For example, the OD 302 of the suppressor 300 typically blocks the sights 202, 203 included on a semi-automatic pistol 200 as shown in FIG. 17. Thus, different sights may need to be installed. An attached suppressor 300 may also increase the length 401 of the pistol with the suppressor to approximately twice, or more, than its original length 201 as shown in FIG. 17. This combined length 401 may discourage a user to attach a suppressor to a pistol. The combined length 401 may also prevent the pistol 200 to be inserted into a holster when the suppressor 300 is attached. Other drawbacks and disadvantages of present semi-automatic handgun suppressor systems may also exist.

SUMMARY

The present disclosure is directed to a suppressor for semi-automatic pistols that may be threaded directly to the barrel.

One embodiment of the disclosure is a pistol suppressor comprising a mount having a first flow path through the mount, the mount configured to connect directly to a barrel of a semi-automatic pistol. The suppressor includes a base tubing having an initial expansion chamber with the base tubing being connected to the mount. The base tube having second flow path through the initial expansion chamber, the second flow path aligned with the first flow path. The suppressor includes a single baffle connected to the base tube, the single baffle having a third flow path through the baffle, the third flow path aligned with the second flow path. The suppressor includes an end cap connected to the single baffle, the end cap having a fourth flow path through the end cap, the fourth flow path aligned with the third flow path. Only the single baffle is positioned between the base tube and the end cap. The pistol suppressor does not include any wipes along the first, second, third, or fourth flow paths.

The mount is connected directly to the barrel of a semi-automatic pistol. The semi-automatic pistol and the suppressor connected to the semi-automatic pistol may be positioned within a holster. The mount, the base tube, the single baffle, and the end cap may have an overall length of 2.5 inches or less. The mount, the base tube, the single baffle, and the end cap may have an overall weight or less than 1.5 ounces.

One embodiment of the present disclosure is a pistol suppressor comprising a mount having a first flow path through the mount, the mount configured to connect directly to a barrel of a semi-automatic pistol. The suppressor includes a base tube having an initial expansion chamber. The base tube being connected to the mount. The base tube having second flow path through the initial expansion chamber, the second flow path aligned with the first flow path. The suppressor includes a first baffle connected to the base tube. The first baffle having a third flow path through the first baffle, the third flow path aligned with the second flow path. The suppressor includes a second baffle connected to the first baffle having a fifth flow path through the second baffle, the fifth flow path aligned with the third flow path. The suppressor includes an end cap connected to the baffle, the end cap having a fourth flow path through the end cap, the fourth flow path aligned with the fifth flow path. Only the first baffle and the second baffle are positioned between the base tube and the end cap. The pistol suppressor does not include any wipes along the first, second, third, fourth, or fifth flow paths.

The mount is connected directly to the barrel of a semi-automatic pistol. The semi-automatic pistol and the suppressor connected to the semi-automatic pistol may be positioned within a holster. The mount, the base tube, the first baffle, the second baffle, and the end cap may have an overall length of three (3) inches or less. The mount, the base tube, the first baffle, the second baffle, and the end cap may have an overall weight or less than 1.8 ounces.

One embodiment of the present disclosure is a pistol suppressor comprising a mount having a first flow path through the mount, the mount configured to connect directly to a barrel of a semi-automatic pistol. The suppressor includes a base tube having an initial expansion chamber. The base tube being connected to the mount. The base tube having second flow path through the initial expansion chamber, the second flow path aligned with the first flow path. The suppressor includes a first baffle connected to the base tube, the first baffle having a third flow path through the first baffle, the third flow path aligned with the second flow path. The suppressor includes a second baffle connected to the first baffle having a fifth flow path through the second baffle, the fifth flow path aligned with the third flow path. The suppressor includes a third baffle connected to the second baffle having a sixth flow path through the third baffle, the sixth flow path aligned with the fifth flow path. The suppressor includes an end cap connected to the baffle, the end cap having a fourth flow path through the end cap, the fourth flow path aligned with the sixth flow path. Only the first baffle, the second baffle, and the third baffle are positioned between the base tube and the end cap. The pistol suppressor does not include any wipes along the first, second, third, fourth, fifth, or sixth flow paths.

The mount is connected directly to the barrel of a semi-automatic pistol. The semi-automatic pistol and the suppressor connected to the semi-automatic pistol may be positioned within a holster. The mount, the base tube, the first baffle, the second baffle, the third baffle, and the end cap may have an overall length of 3.5 inches or less. The mount, the base tube, the first baffle, the second baffle, third baffle, and the end cap may have an overall weight of less than 2.3 ounces.

One embodiment of the present disclosure is a pistol suppressor comprising a mount configured to connect directly to a barrel of a semi-automatic pistol without a booster positioned between the mount and the barrel. The suppressor includes a base tube having an initial expansion chamber. The base tube being connected to the mount and at least one baffle connected to the base tube. The suppressor includes an end cap connected to the at least one baffle. The suppressor includes a flow path through the pistol suppressor from the mount to the end cap and the pistol suppressor does not include any wipes along the flow path.

Figure 1:
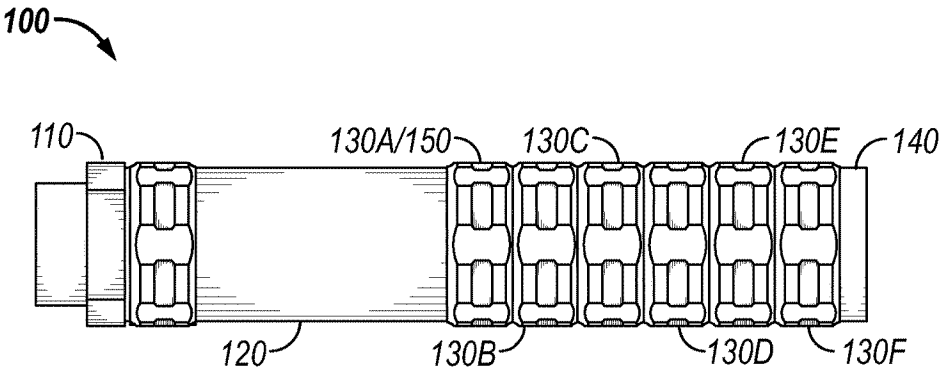
FIG. 1 shows an embodiment of a modular pistol suppressor that may be mounted directly to the barrel of a semi-automatic pistol.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a modular suppressor 100 that may be connected directly to the barrel of a semi-automatic pistol without the use of a booster or LID device. The modular suppressor 100 does not interfere with the action due to the decrease in weight and length compared to traditional pistol suppressors. The suppressor 100 includes a mount 110 that may be threaded directly onto the barrel of a pistol. As used herein, a mount couples the suppressor 100 directly to the barrel of a pistol and does not temporarily decouple the suppressor from the barrel such as a booster, Nielsen device, or LID device when the pistol is discharged. A base tube 120 having an initial chamber 125 (shown in FIGS. 4-9) is connected directly to the mount 110. In other words, a booster device is not connected between the mount 110 and the base tube 120. The base tube 120 may be threaded into the mount 110. A plurality of baffles 130A-130F are then connected between the base tube 120 and an end cap 140. The modularity of the suppressor 100 enables the number of baffles 130A-130F to be varied depending of application of the user. For example, the suppressor 100 may include a single baffle (generically 130) between the base tube 120 and the end cap 140. The overall length of the suppressor 100 may be 4.6 inches or less depending on the number of baffles positioned between the base tube 120 and the end cap 140. The overall weight of the suppressor 100 may be 2.5 ounces or less depending on the number of baffles positioned between the base tube 120 and the end cap 140.

A pistol with the suppressor 100 connected to barrel may be able to be inserted into a holster depending on the number of baffles 130 positioned between the base tube 120 and the end cap 140 as well as the configuration of the holster. The suppressor 100 of the present disclosure may be able to be concealed while connected to a pistol due to the decrease in overall length of the suppressor 100 compared to traditional pistol suppressors.

In other embodiments, the suppressor 100 may include a tube extension 150 instead of one of the baffles 130A. The suppressor 100 includes a mount 110 that may be threaded directly onto the barrel of a pistol. A base tube 120 having an initial chamber 125 (shown in FIGS. 4-9) is connected to the mount 110. The base tube 120 may be threaded into the mount 110. A plurality of baffles 130B-130F are then connected between the base tube 120 and an end cap 140. The tube extension 150 may be position at various locations between the base tube 120 and the end cap 140. The positioning of the tube extension 150 at various positions between the base tube and the end cap 140 enables the user to tune the sound of discharge from a firearm. For example, the tube extension 150 may be positioned between the base tube 120 and a baffle 130B. Likewise, the tube extension 150 may be positioned between baffles 130B, 130C with baffle 130B being connected directly to the base tube 120. The tube extension 150 may be connected between any two baffles 130B-130F or may be positioned between baffle 130F and the end cap 140 as would be appreciated by one of ordinary skill in the art having the benefit of this disclosure.

Figure 2:
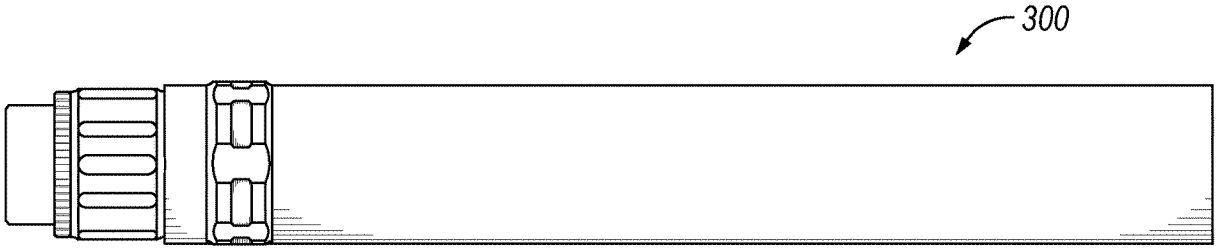
FIG. 2 shows an embodiment of a modular pistol suppressor that may be mounted directly to the barrel of a semi-automatic pistol next to a conventional pistol suppressor.
Figure 2:
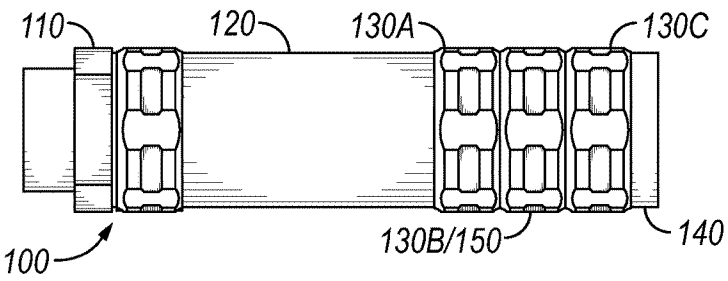

FIG. 2 shows a modular suppressor 100 that may be connected directly to the barrel of a semi-automatic pistol without the use of a booster or LID device next to a traditional pistol suppressor 300. The overall length of the modular suppressor 100 is much shorter than the overall length of the traditional suppressor 300. The suppressor 100 does not interfere with the action due to the decrease in weight and length compared to traditional pistol suppressors. The suppressor 100 includes a mount 110 that may be threaded directly onto the barrel of a pistol. A base tube 120 is connected to the mount 110. The base tube 120 may be threaded into the mount 110. A plurality of baffles 130A-130C are then connected between the base tube 120 and an end cap 140. The modularity of the suppressor 100 enables the number of baffles 130A-130C to be varied depending of application of the user. The overall length of the suppressor 100 may be 3.5 inches or less when only three baffles are positioned between the end cap 140 and the base tube 120. The suppressor 100 may weigh 2.3 ounces or less.

In one embodiment, the suppressor 100 may include a mount 110 that may be threaded directly onto the barrel of a pistol. A base tube 120 is connected to the mount 110. The base tube 120 may be threaded into the mount 110. A tube extension 150 and a plurality of baffles 130B, 130C are then connected between the base tube 120 and an end cap 140. The tube extension may be positioned between a first baffle 130B and the base tube 120. Alternatively, the tube extension 150 may be positioned between the two baffles 130B, 130C, or may be positioned between the last baffle 130C and the end cap 140. The different configurations of the baffles 130B, 130C and the tube extension 150 enables a user to tune the sound from a suppressed discharged from a firearm.

Figure 3:
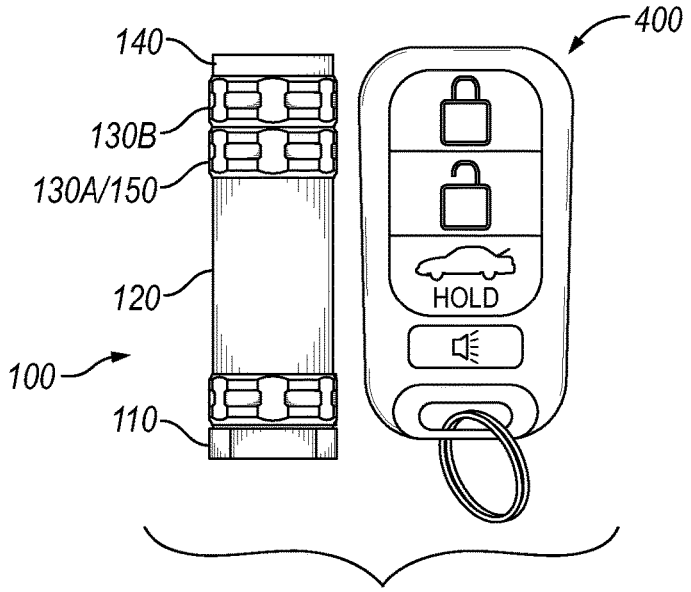
FIG. 3 shows an embodiment of a modular pistol suppressor that may be mounted directly to the barrel of a semi-automatic pistol next to a key fob for an automobile.

FIG. 3 shows an embodiment of a modular pistol suppressor 100 that may be mounted directly to the barrel of a semi-automatic pistol next to a typical key fob 400 for an automobile as an exemplary size reference. The suppressor 100 does not interfere with the action due to the decrease in weight and length compared to traditional pistol suppressors. The suppressor 100 includes a mount 110 that may be threaded directly onto the barrel of a pistol. A base tube 120 is connected to the mount 110. The base tube 120 may be threaded into the mount 110. A plurality of baffles 130A, 130B are then connected between the base tube 120 and an end cap 140. The modularity of the suppressor 100 enables the number of baffles 130A, 130B to be varied depending of application of the user. The overall length of the suppressor 100 may be three (3) inches or less when only three baffles are positioned between the end cap 140 and the base tube 120. The suppressor 100 may weigh 1.8 ounces or less.

One embodiment of the present disclosure is a suppressor that has an OD of 1.05 inches or less. Such an OD will not obscure the sights of the pistol onto which the suppressor is installed. Typical pistol suppressor are often as long as, or even longer, than the pistol onto which the suppressor is to be attached. This added length to the pistol may discourage a user from attaching the suppressor to a pistol. Further, the added length does not allow the pistol to be properly holstered in a normal holster when a suppressor is attached. In one embodiment, the suppressor 100 has a length that is less than the length of a semi-automatic pistol. In one embodiment, the suppressor 100 has a length that is ½ or less than the length of a semi-automatic pistol.

Another embodiment of the modular pistol suppressor 100 shown in FIG. 1 is a suppressor 100 that includes a mount 110, a base tube 120 is connected to the mount 110, a tube extension 150, a single baffle 130B, and an end cap 140. The modularity of the suppressor enables the tube extension 150 may be connected between the base tube 120 and the single baffle 130B or may be connected between the single baffle 130B and the end cap 140. The overall length of the suppressor 100 may be three (3) inches or less when a single baffle and a tube extension are positioned between the end cap 140 and the base tube 120. The suppressor 100 may weigh 1.8 ounces or less FIGS. 4-9 show cross-sectional views of embodiments of a modular firearm suppressor 100 that includes a mount 110, base tube 120, tube extension 150, baffles 130A-130E, and an end cap 140. The base tube 120 includes an initial expansion chamber 125. The suppressor 100 includes a flow path 160 through the suppressor 100 through which a fired projectile may travel as would be appreciated by one of ordinary skill in the art. The flow path 160 is comprised of a flow path 160A through the mount 110, a flow path 160B through the base tube 120, a flow path 160C through the tube extension 150, a flow path 160D through a first baffle 130A, a flow path 160E through the second baffle 130B, a flow path 160F through the third baffle 130C, a flow path 160G through the fourth baffle 130D, a flow path 160H through the fifth baffle 130E, and a flow path 160I through the end cap 140. These individual flow paths 160A-160I are aligned for form a flow path 160 through the suppressor 100.

Figure 4:
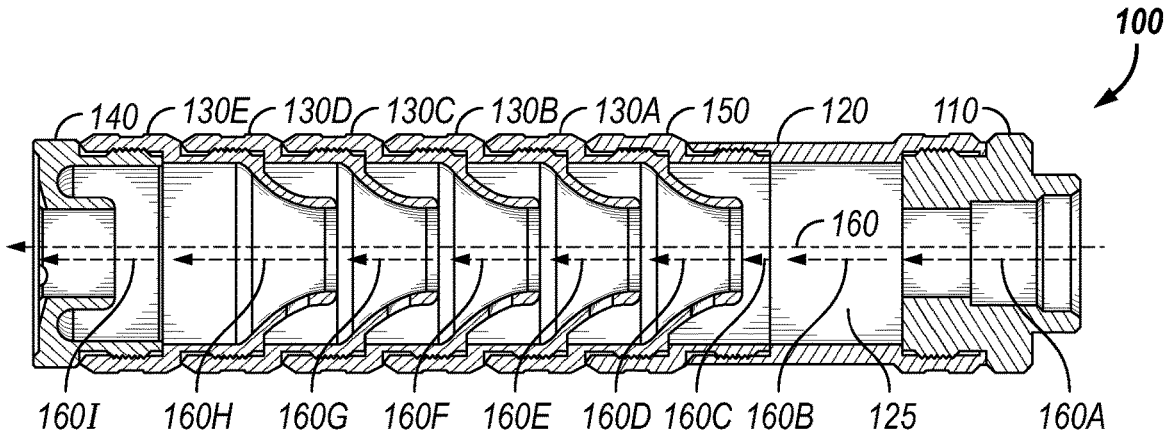
FIGS. 4-9 show cross-sectional views of embodiments of a modular firearm suppressor that includes a mount, a base tube, a tube extension, five baffles, and an end cap.

The suppressor 100 includes a tube extension 150 that may be positioned at various locations along the suppressor 100. The modularity of the suppressor 100 enables the tube extension 150 to be positioned at different locations, which may be used to tune the sound from the suppressor 100. For example, FIG. 4 shows the tube extension 150 positioned between the base tube 120 and the first baffle 130A. In this configuration, the tube extension 150 increases the size of the initial chamber 125 of the base tube 120.

Figure 5:
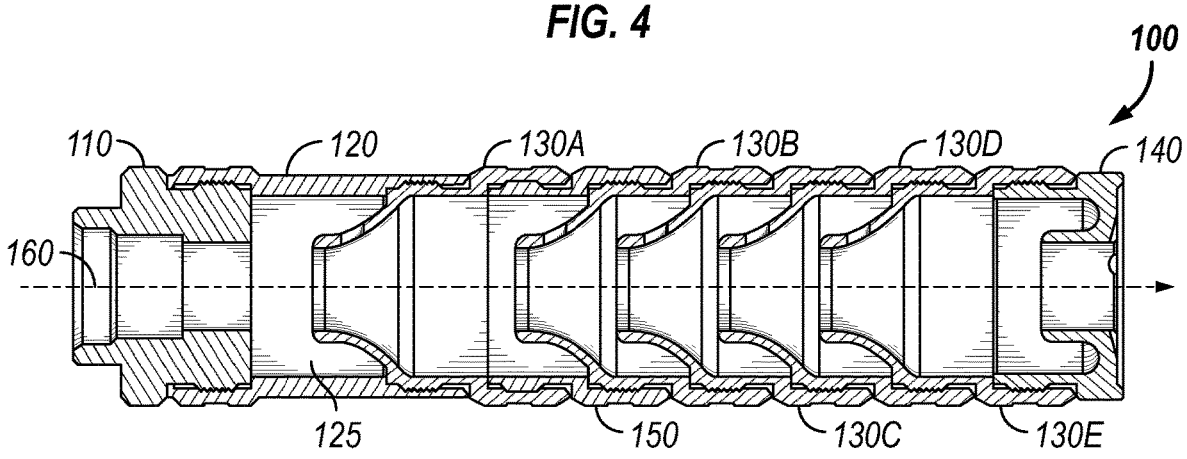
Figure 6:
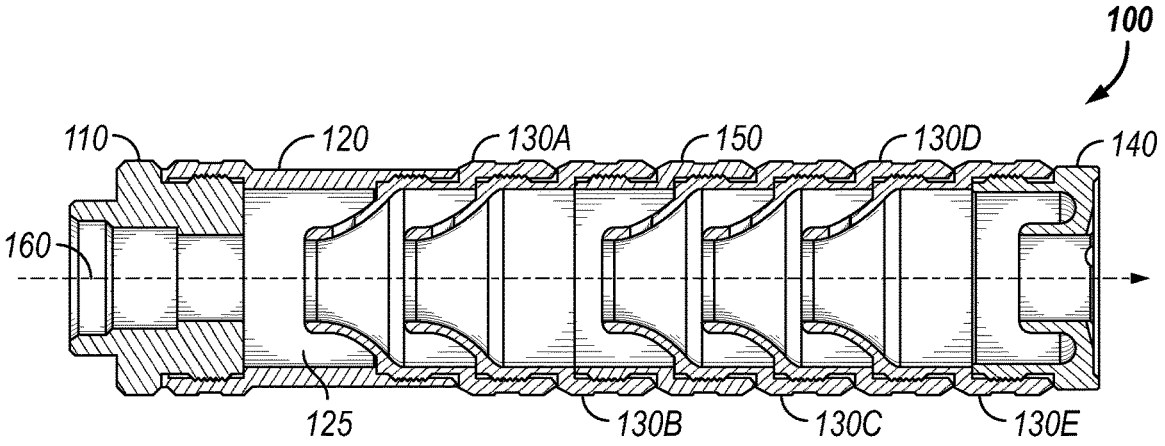
Figure 7:
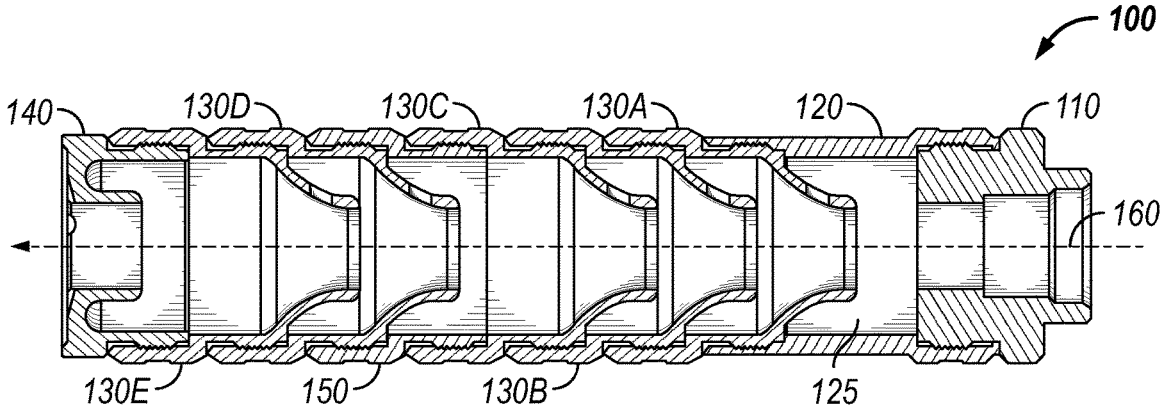
Figure 8:
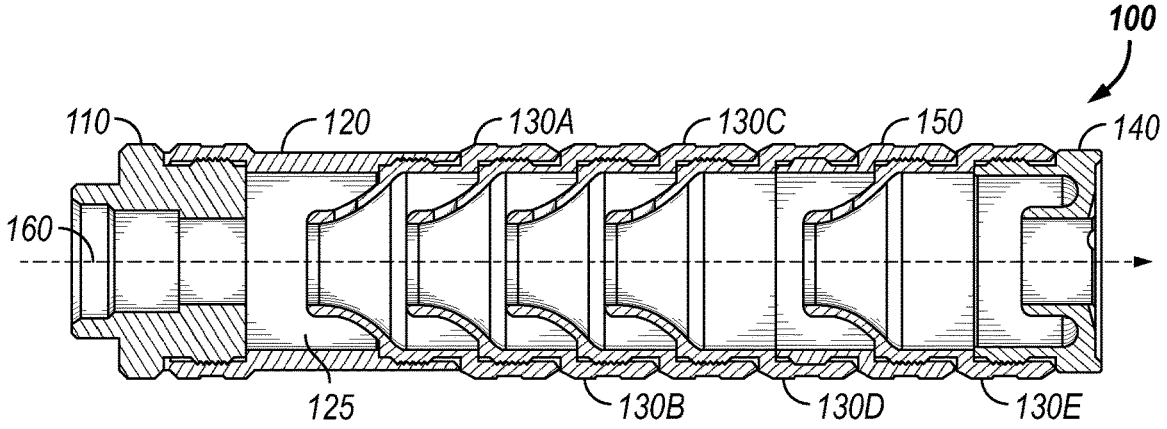
Figure 9:
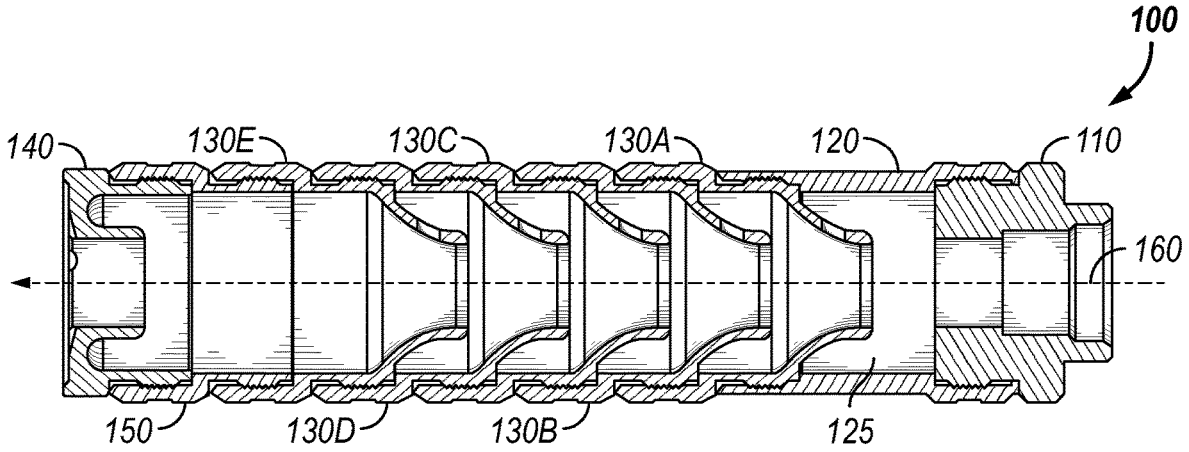

FIG. 5 shows the tube extension 150 positioned between the first baffle 130A and the second baffle 130B. FIG. 6 shows the tube extension 150 positioned between the second baffle 130B and the third baffle 130C. FIG. 7 shows the tube extension 150 positioned between the third baffle 130C and the fourth baffle 130D. FIG. 8 shows the tube extension 150 positioned between the fourth baffle 130D and the fifth baffle 130E. FIG. 9 shows the tube extension 150 positioned between the fifth baffle 130E and the end cap 140.

The tube extension 150 may be moved to various positions along the suppressor 100 as shown in FIGS. 4-9, which may be used to tune the sound from the suppressor 100 when a round is discharged from a firearm connected to the suppressor 100 via the mount 110. As discussed herein, the suppressor 100 may be mounted directly to the barrel of a semi-automatic pistol without a booster due to the short length and reduced weight of the suppressor. Changing the tone of the discharge sound may be important even if the sound level is not changing. For example, the sound from the E string of a guitar sounds differently from the sound from the B string of a guitar even when both are played having the same level of decibels. As another example, a car horn and leaf blower may have approximately the same decibel level, but sound differently. The movement of the tube extension 150 along the suppressor 100 enables a user to tune the discharge sound or tone.

The number of baffles 130A-130E shown in the suppressors 100 of FIGS. 4-9 are shown for illustrative purposes and may be varied as would be appreciated by one of ordinary skill in the art having the benefit of this disclosure. For example, the suppressor 100 may include a single baffle 130A, a base tube 120, a mount 110, an extension tube 150, and an end cap 140. In this configuration, the extension tube 150 may be positioned between the base tube 120 and the baffle 130A or may be positioned between the end cap 140 and the baffle 130A. In yet another non-limiting example, the suppressor 100 may include two baffles 130A, 130B, a mount 110, a base tube 120, an extension tube 150, and an end cap 140. The extension tube 150 may be positioned between the base tube 120 and the first baffle 130A, may be positioned between the two baffles 130A, 130B, or may be positioned between the end cap 140 and the second baffle 130B.

Figure 10:
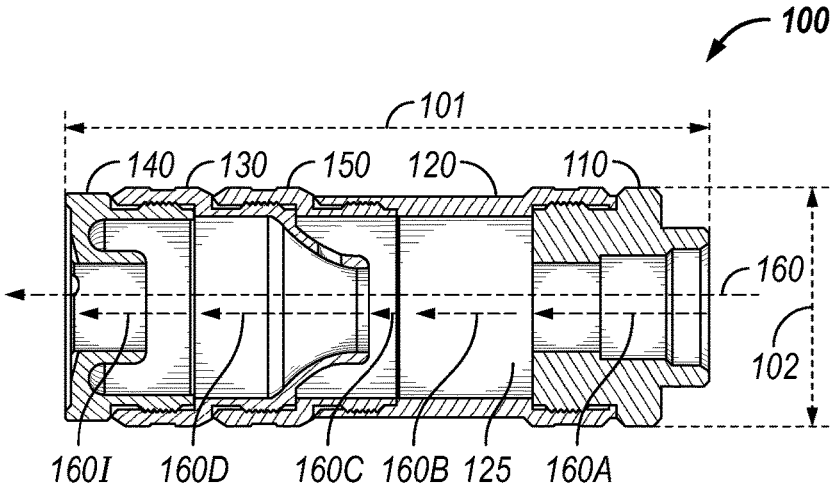
FIGS. 10 and 11 shows cross-sectional views of embodiments of a modular firearm suppressor that includes a mount, a base tube, a tube extension, a single baffle, and an end cap.

FIG. 10 show a cross-sectional view of an embodiment of a modular firearm suppressor 100 that includes a mount 110, base tube 120, tube extension 150, a baffle 130, and an end cap 140. The base tube 120 includes an initial expansion chamber 125. The modular suppressor 100 may be connected directly to the barrel of a semi-automatic pistol without the use of a booster or LID device. The modular suppressor 100 does not interfere with the action due to the decrease in weight and length compared to traditional pistol suppressors. The suppressor 100 includes a mount 110 that may be threaded directly onto the barrel of a pistol. The base tube 120 is connected directly to the mount 110. In other words, a booster device is not connected between the mount 110 and the base tube 120. The base tube 120 may be threaded into the mount 110. A tube extension 150 is connected to the base tube 120. A single baffle 130 is connected between the tube extension 150 and an end cap 140.

The suppressor 100 includes a flow path 160 through the suppressor 100 through which a fired projectile may travel as would be appreciated by one of ordinary skill in the art. The flow path 160 is comprised of a flow path 160A through the mount 110, a flow path 160B through the base tube 120, a flow path 160C through the tube extension 150, a flow path 160D through the baffle 130, and a flow path 160I through the end cap 140. These individual flow paths 160A, 160B, 160C, 160D, and 160I are aligned for form a flow path 160 through the suppressor 100 as would be appreciated by one of ordinary skill in the art having the benefit of this disclosure.

Figure 11:
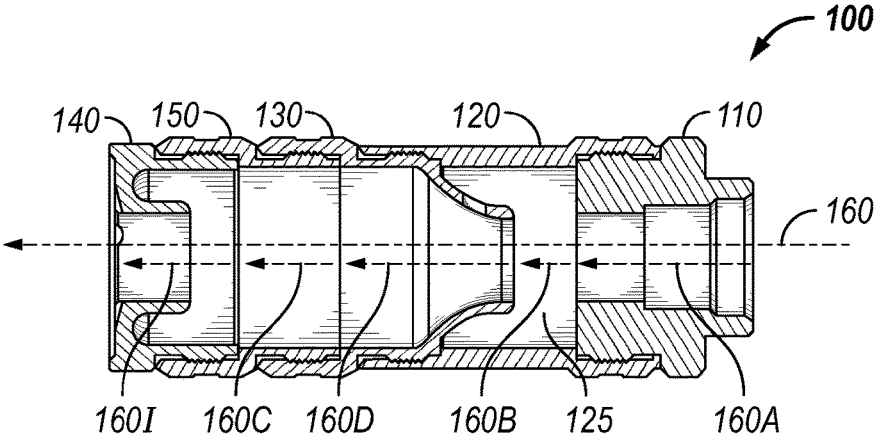

FIG. 11 show a cross-sectional view of an embodiment of a modular firearm suppressor 100 that includes a mount 110, base tube 120, tube extension 150, a baffle 130, and an end cap 140. The tube extension 150 is positioned between the baffle 130 and the end cap 140. The modularity of the suppressor 100 enables the tube extension to be positioned in multiple locations along the length of the suppressor 100 enabling a user to tune the sound of the discharge from a firearm by locating the tube extension in different locations as would be appreciated by one of ordinary skill in the art having the benefit of this disclosure. The flow path 160 through this configuration of the suppressor is comprised of a flow path 160A through the mount 110, a flow path 160B through the base tube 120, a flow path 160D through the baffle 130, a flow path 160C through the tube extension 150, and a flow path 160I through the end cap 140.

Figure 12:
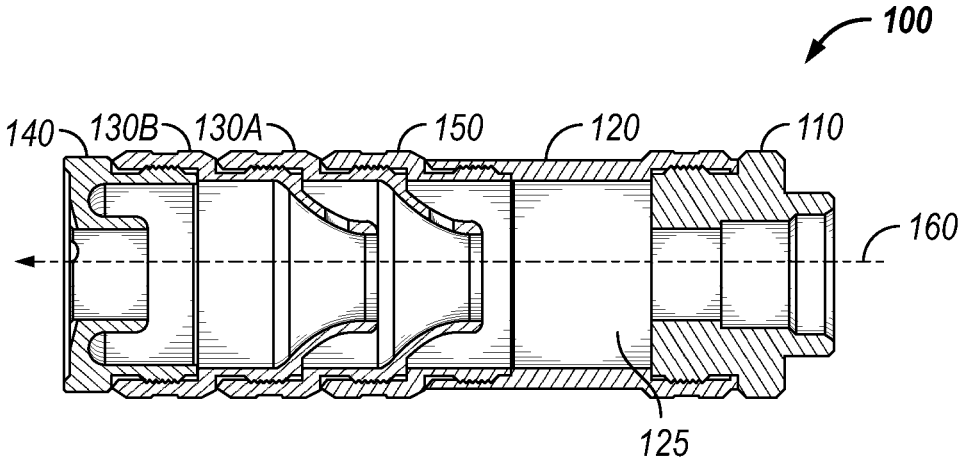
FIGS. 12-14 show cross-sectional views of embodiments of a modular firearm suppressor that includes a mount, a base tube, a tube extension, two baffles, and an end cap.

FIG. 12 show a cross-sectional view of an embodiment of a modular firearm suppressor 100 that includes a mount 110, base tube 120, tube extension 150, a first baffle 130A, a second baffle 130B, and an end cap 140. The base tube 120 includes an initial expansion chamber 125. The modular suppressor 100 may be connected directly to the barrel of a semi-automatic pistol without the use of a booster or LID device. The modular suppressor 100 does not interfere with the action due to the decrease in weight and length compared to traditional pistol suppressors. The suppressor 100 includes a mount 110 that may be threaded directly onto the barrel of a pistol. The base tube 120 is connected directly to the mount 110. In other words, a booster device is not connected between the mount 110 and the base tube 120. The base tube 120 may be threaded into the mount 110. A tube extension 150 is connected to the base tube 120. A first baffle 130A is connected between the tube extension 150. A second baffle 130B is connected to the first baffle 130A. The second baffle 130B is positioned between the first baffle 130A and an end cap 140. A flow path 160 extends through the entire suppressor 100 as would be appreciated by one of ordinary skill in the art having the benefit of this disclosure.

Figure 13:
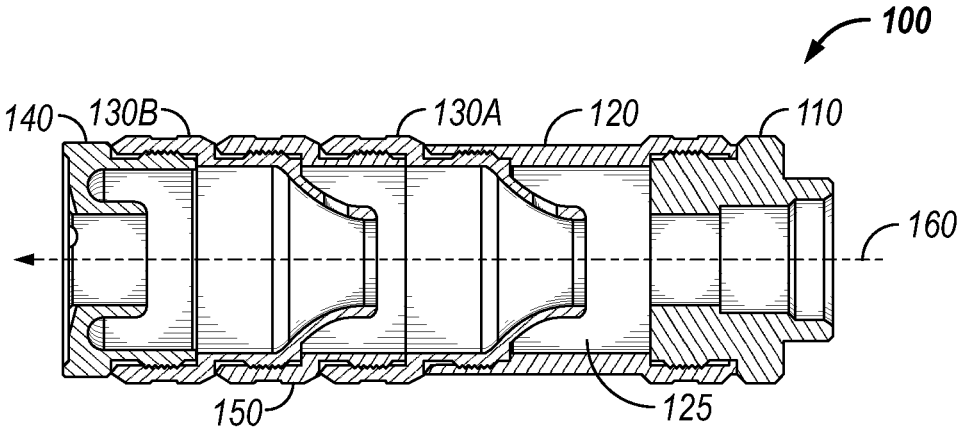

FIG. 13 also shows a cross-sectional view of an embodiment of a modular firearm suppressor 100 that includes a mount 110, base tube 120, tube extension 150, a first baffle 130A, a second baffle 130B, and an end cap 140. However, the tube extension 150 is positioned between the first baffle 130A and the second baffle 130B. The first baffle 130A is connected to the base tube 120. A flow path 160 extends through the entire suppressor 100 as would be appreciated by one of ordinary skill in the art having the benefit of this disclosure.

Figure 14:
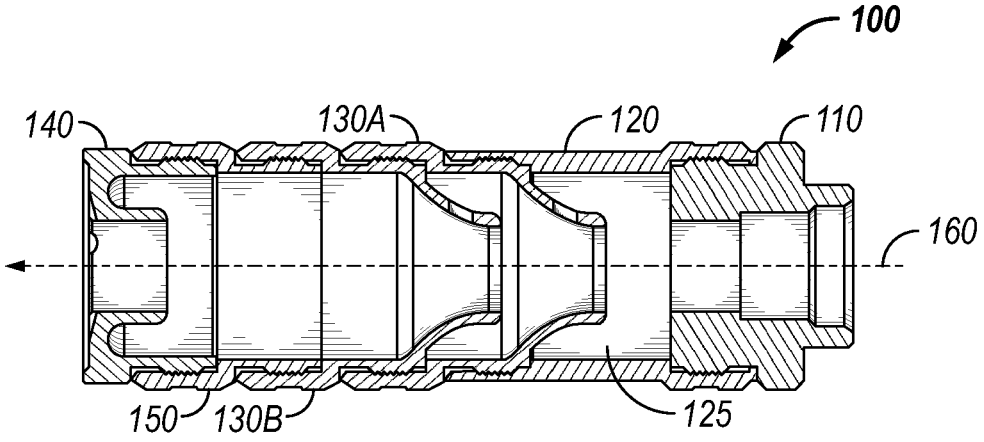

FIG. 14 also shows a cross-sectional view of an embodiment of a modular firearm suppressor 100 that includes a mount 110, base tube 120, tube extension 150, a first baffle 130A, a second baffle 130B, and an end cap 140. However, the tube extension 150 is positioned between the second baffle 130B and the end cap 140. The first baffle 130A is connected to the base tube 120 and the second baffle 130B is connected to the first baffle 130A. A flow path 160 extends through the entire suppressor 100 as would be appreciated by one of ordinary skill in the art having the benefit of this disclosure. The modularity of the suppressor 100, as illustrated in FIGS. 12-14, enables the tube extension 150 to be located at various positioned along the suppressor, which enables a user to tune the discharge sound from the suppressor as discussed herein.

Figure 15:
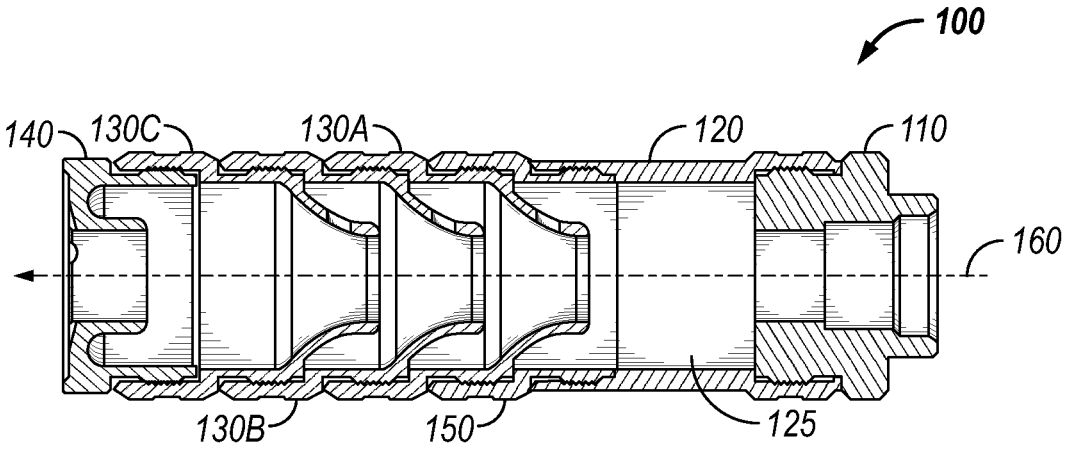
FIG. 15 shows a cross-sectional view of an embodiment of a modular firearm suppressor that includes a mount, a base tube, a tube extension, three baffles, and an end cap.

FIG. 15 show a cross-sectional view of an embodiment of a modular firearm suppressor 100 that includes a mount 110, base tube 120, tube extension 150, a first baffle 130A, a second baffle 130B, a third baffle 130C, and an end cap 140. The base tube 120 includes an initial expansion chamber 125. The modular suppressor 100 may be connected directly to the barrel of a semi-automatic pistol without the use of a booster or LID device. The modular suppressor 100 does not interfere with the action due to the decrease in weight and length compared to traditional pistol suppressors. The suppressor 100 includes a mount 110 that may be threaded directly onto the barrel of a pistol. The base tube 120 is connected directly to the mount 110. In other words, a booster device is not connected between the mount 110 and the base tube 120. The base tube 120 may be threaded into the mount 110. A tube extension 150 is connected to the base tube 120. A first baffle 130A is connected between the tube extension 150. A second baffle 130B is connected to the first baffle 130A. A third baffle 130C is connected to the second baffle 130B. The third baffle 130C is positioned between the second baffle 130B and an end cap 140. A flow path 160 extends through the entire suppressor 100 as would be appreciated by one of ordinary skill in the art having the benefit of this disclosure. The tube extension 150 may be located at various positioned along the length of the suppressor 100 as would be recognized by one of ordinary skill in the art having the benefit of this disclosure. The modularity of the suppressor 100 enables a user to tone the discharge sound from the suppressor as would be appreciated by one of ordinary skill in the art having the benefit of this disclosure.

Figure 16:
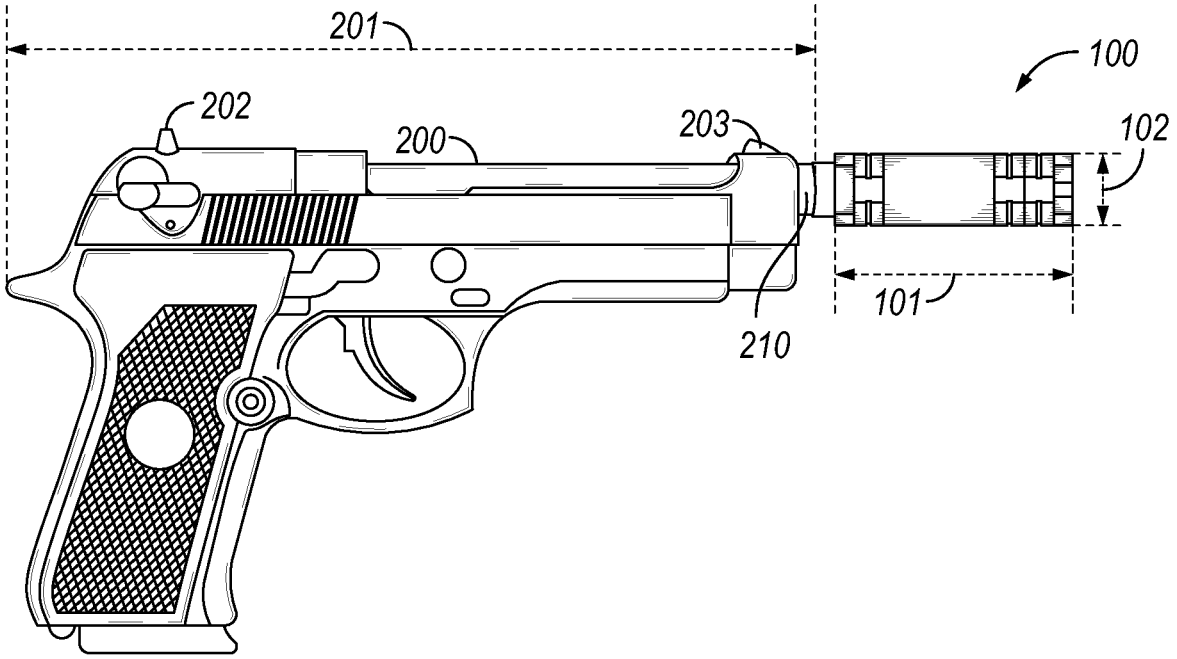
FIG. 16 shows a schematic of an embodiment of a modular firearm suppressor connected directly to the barrel of a semi-automatic pistol.
Figure 17:
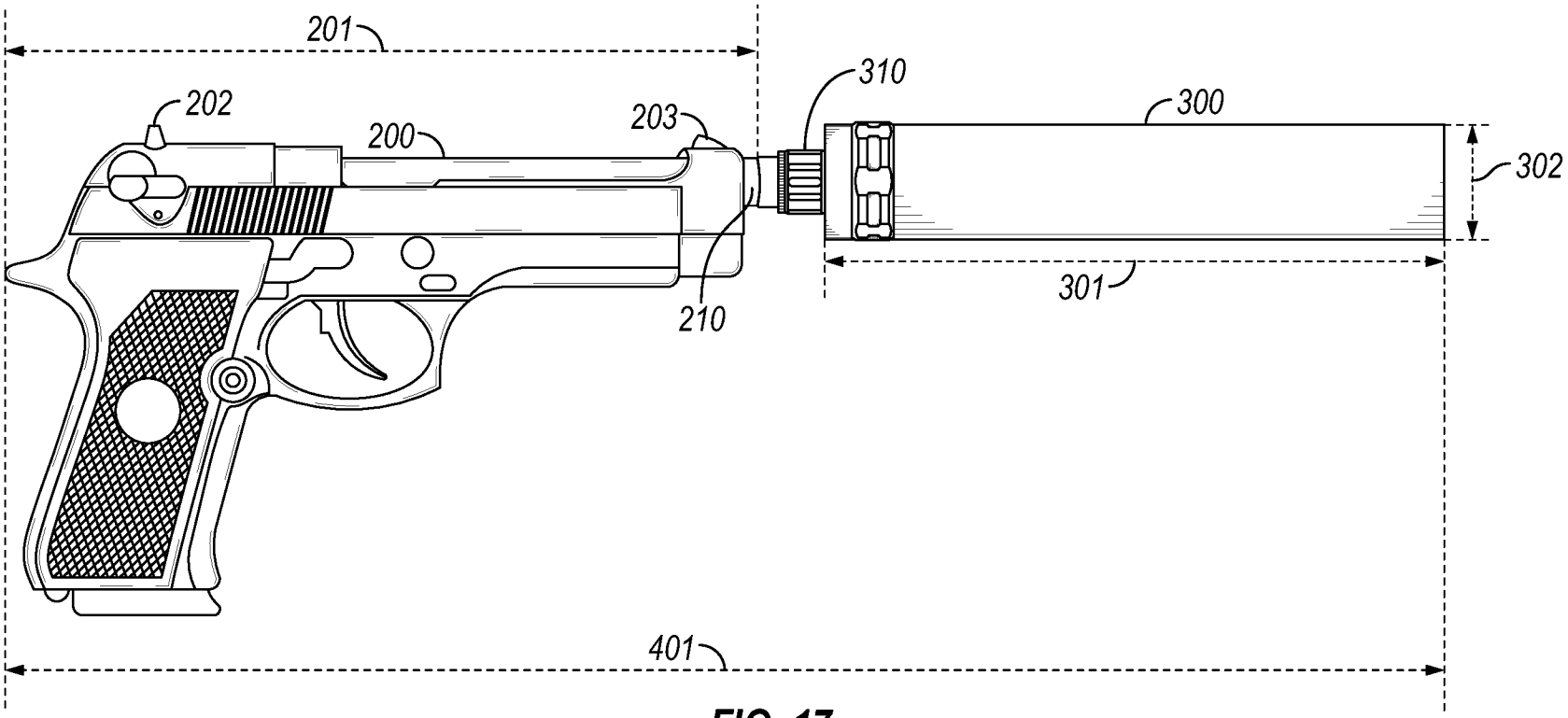
FIG. 17 (Prior Art)
FIG. 17 shows a schematic of a prior art suppressor connected to the barrel of a semi-automatic pistol with a booster positioned between the barrel and the suppressor.

FIG. 16 shows a schematic of an embodiment of a modular firearm suppressor 100 connected directly to the barrel 210 of a semi-automatic pistol 200. The pistol 200 has a first length 201 and the suppressor 100 has a second length 101. The second length 101 of the suppressor 100 may be one half, or less, than the first length of the pistol 200. The second length 101 of the suppressor may be 2.5 inches or less. The suppressor 100 may weigh 1.5 ounces or less. The suppressor 100 has an OD 102 that does obstruct of block the line of sight through the sights 202, 203 of the pistol 200. For example, the OD 102 of the suppressor may be 1.05 inches or less.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A semi-automatic pistol suppressor comprising:

a mount having a first end and a second end, the mount having a first flow path through the mount, the first end of the mount being configured to connect directly to a barrel of a semi-automatic pistol;

a base tube having an initial expansion chamber removably connected to the mount, the base tube having a second flow path through the initial expansion chamber, the second flow path aligned with the first flow path;

a single baffle removably connected to the base tube, the single baffle having a third flow path through the baffle, the third flow path aligned with the second flow path;

an end cap removably connected to the single baffle, the end cap having a fourth flow path through the end cap, the fourth flow path aligned with the third flow path;

a tube extension positioned between the base tube and the end cap;

wherein the single baffle is the only baffle positioned between the first end of the mount and the end cap; and wherein the pistol suppressor does not include any wipes along the first, second, third, or fourth flow paths.

2. The pistol suppressor of claim 1, wherein the pistol suppressor has an outer diameter of 1.05 inches or less.

3. The pistol suppressor of claim 1, wherein the tube extension is removably connected between the base tube and the single baffle.

4. The pistol suppressor of claim 1, wherein the tube extension is removably connected between the single baffle and the end cap.

5. The pistol suppressor of claim 1, wherein the pistol suppressor does not include a booster, a Nielsen device, or a linear inertial decoupler device.

6. The pistol suppressor of claim 5, wherein the semi-automatic pistol has a first length and the suppressor has a second length and wherein the second length is 12 or less of the first length.

7. The pistol suppressor of claim 5, wherein the pistol suppressor has an outer diameter that does not obstruct sights on the pistol.

8. The pistol suppressor of claim 1, wherein the mount, the base tube, the single baffle, the tube extension, and the end cap have an overall length of 2.5 inches or less and an overall weight of 1.5 ounces or less.

9. A pistol suppressor comprising:

a mount having a first end and a second end, the mount having a first flow path through the mount, the first end of the mount being configured to connect directly to a barrel of a semi-automatic pistol;

a base tube having an initial expansion chamber, the base tube being removably connected to the mount, the base tube having a second flow path through the initial expansion chamber, the second flow path aligned with the first flow path;

a first baffle removably connected to the base tube, the first baffle having a third flow path through the first baffle, the third flow path aligned with the second flow path;

a second baffle removably connected to the first baffle having a fifth flow path through the second baffle, the fifth flow path aligned with the third flow path;

an end cap removably connected to the second baffle, the end cap having a fourth flow path through the end cap, the fourth flow path aligned with the fifth flow path;

wherein the first baffle and the second baffle are the only baffles positioned between the first end of the mount and the end cap;

a tube extension positioned between the base tube and the end cap; and wherein the pistol suppressor does not include any wipes along the first, second, third, fourth, or fifth flow paths.

10. The pistol suppressor of claim 9, wherein the tube extension is removably connected between the base tube and the first baffle.

11. The pistol suppressor of claim 9, wherein the tube extension is removably connected between the first baffle and the second baffle.

12. The pistol suppressor of claim 9, wherein the tube extension is removably connected between the second baffle and the end cap.

13. A pistol suppressor comprising:

a mount having a first end and a second end, the mount having a first flow path through the mount, the mount configured to connect directly to a barrel of a semi-automatic pistol;

a base tube having an initial expansion chamber, the base tube being removably connected to the mount, the base tube having a second flow path through the initial expansion chamber, the second flow path aligned with the first flow path;

a first baffle removably connected to the base tube, the first baffle having a third flow path through the first baffle, the third flow path aligned with the second flow path;

a second baffle removably connected to the first baffle having a fifth flow path through the second baffle, the fifth flow path aligned with the third flow path;

a third baffle removably connected to the second baffle having a sixth flow path through the third baffle, the sixth flow path being aligned with the fifth flow path;

an end cap removably connected to the third baffle, the end cap having a fourth flow path through the end cap, the fourth flow path aligned with the sixth flow path, wherein the first baffle, the second baffle, and the third baffle, are each positioned between the end cap and the base tube;

a tube extension positioned between the base tube and the end cap;

wherein the first baffle, the second baffle, and the third baffle are the only baffles positioned between the first end of the mount and the end cap; and wherein the pistol suppressor does not include any wipes along the first, second, third, fourth, fifth, or sixth flow paths.

14. The pistol suppressor of claim 13, wherein the tube extension is removably connected between the base tube and the first baffle.

15. The pistol suppressor of claim 13, wherein the tube extension is removably connected between the first baffle and the second baffle.

16. The pistol suppressor of claim 13, wherein the tube extension is removably connected between the second baffle and the third baffle.

17. The pistol suppressor of claim 13, wherein the tube extension is removably connected between the third baffle and the end cap.

18. A pistol suppressor comprising:

a mount configured to connect directly to a barrel of a semi-automatic pistol without a booster positioned between the mount and the barrel;

a base tube having a length, the base tube having a substantially unobstructed center bore along the length, the substantially unobstructed center bore includes an initial expansion chamber, the base tube being removably connected to the mount;

at least one baffle removably connected to the base tube;

an end cap removably connected to the at least one baffle;

a tube extension, wherein the tube extension may be positioned at more than one position along the pistol suppressor;

a flow path through the pistol suppressor from the mount to the end cap; and wherein the pistol suppressor does not include any wipes along the flow path.

* * * * *